US008661761B2

(12) United States Patent
Williams

(10) Patent No.: US 8,661,761 B2
(45) Date of Patent: Mar. 4, 2014

(54) EDGE ASSEMBLIES FOR SLATE AND TILE ROOFS

(76) Inventor: John Williams, Wells, VT (US)

( * ) Notice: Subject to any disclaimer, the term of this patent is extended or adjusted under 35 U.S.C. 154(b) by 238 days.

(21) Appl. No.: 13/484,380

(22) Filed: May 31, 2012

(65) Prior Publication Data

US 2012/0304578 A1 Dec. 6, 2012

Related U.S. Application Data

(60) Provisional application No. 61/492,529, filed on Jun. 2, 2011.

(51) Int. Cl.
*E04D 1/34* (2006.01)

(52) U.S. Cl.
USPC ..... 52/551; 52/58; 52/60; 52/94; 52/97

(58) Field of Classification Search
USPC ..... 52/58, 60, 62, 94, 95, 97, 716.2, 52/745.06, 746.11, 551, 712
See application file for complete search history.

(56) References Cited

U.S. PATENT DOCUMENTS

| | | | | | |
|---|---|---|---|---|---|
| 397,534 | A | * | 2/1889 | Carroll | 52/15 |
| 476,381 | A | * | 6/1892 | Hawthorne | 52/276 |
| 505,526 | A | * | 9/1893 | Hawthorne | 52/547 |
| 757,285 | A | * | 4/1904 | Duchemin | 52/547 |
| 1,236,211 | A | * | 8/1917 | Russell | 52/46 |
| 1,236,303 | A | * | 8/1917 | Hope | 52/46 |
| 1,396,732 | A | * | 11/1921 | Cramer | 52/60 |
| 1,585,897 | A | * | 5/1926 | Davidson | 52/470 |
| 1,731,328 | A | * | 10/1929 | Witter | 52/58 |
| 1,886,462 | A | * | 11/1932 | Bever | 52/60 |
| 2,026,608 | A | * | 1/1936 | Calafati | 52/416 |
| 2,131,844 | A | * | 10/1938 | Mooshian | 52/95 |
| 2,149,818 | A | * | 3/1939 | North | 52/409 |
| 2,184,092 | A | * | 12/1939 | Buick | 52/61 |
| 2,252,834 | A | * | 8/1941 | Callaway | 52/61 |
| 2,734,602 | A | * | 2/1956 | Dawson | 52/212 |
| 2,929,237 | A | * | 3/1960 | Lancer | 52/60 |
| 2,995,870 | A | * | 8/1961 | O'Hanlon, Jr. | 52/62 |
| 3,024,573 | A | * | 3/1962 | McKinley | 52/96 |
| 3,093,931 | A | * | 6/1963 | Waring | 52/96 |
| 3,187,464 | A | * | 6/1965 | Sharp | 52/716.1 |
| 3,246,433 | A | * | 4/1966 | Eriksson | 52/98 |
| 3,571,992 | A | * | 3/1971 | Comiskey | 52/60 |
| 3,922,824 | A | * | 12/1975 | Izawa et al. | 52/94 |
| 3,967,419 | A | * | 7/1976 | Robinson | 52/16 |
| 4,067,152 | A | * | 1/1978 | Wolma | 52/60 |
| 4,071,987 | A | * | 2/1978 | Hickman | 52/94 |
| 4,185,436 | A | * | 1/1980 | Vallee | 52/518 |
| 4,218,857 | A | * | 8/1980 | Vallee | 52/94 |

(Continued)

FOREIGN PATENT DOCUMENTS

| | | | | | |
|---|---|---|---|---|---|
| GB | 2164369 | A | * | 3/1986 | E04D 13/15 |

*Primary Examiner* — Robert Canfield
*Assistant Examiner* — Charissa Ahmad
(74) *Attorney, Agent, or Firm* — Lawrence J. Shurupoff

(57) ABSTRACT

An integral roof and gable edge assembly includes a metal or plastic sheet formed with positioning surfaces to facilitate slate tile installation by relatively unskilled roofers. The roof and gable assemblies include one or more hooks for holding one or more slate, ceramic or other similar roofing tiles in fixed position along the eaves and/or gables of a roof. A lift arm can be provided on the roof assemblies to replace cant strips and simplify tile installation. Tiles can be easily installed without nailing through the tiles.

9 Claims, 4 Drawing Sheets

(56) References Cited

U.S. PATENT DOCUMENTS

| | | | | | |
|---|---|---|---|---|---|
| 4,241,549 | A * | 12/1980 | Hall et al. | 52/60 |
| 4,404,777 | A * | 9/1983 | Lolley et al. | 52/60 |
| 4,418,505 | A * | 12/1983 | Thompson | 52/95 |
| 4,472,913 | A * | 9/1984 | Hickman | 52/96 |
| 4,594,820 | A * | 6/1986 | Render | 52/60 |
| 4,662,129 | A * | 5/1987 | Hickman | 52/96 |
| 4,706,421 | A * | 11/1987 | Thompson | 52/94 |
| 4,848,045 | A * | 7/1989 | Nichols et al. | 52/60 |
| 4,967,521 | A * | 11/1990 | Pike | 52/95 |
| 5,590,498 | A * | 1/1997 | Mokres | 52/287.1 |
| 5,642,596 | A * | 7/1997 | Waddington | 52/546 |
| 5,737,879 | A * | 4/1998 | Sweet | 52/12 |
| 5,740,633 | A * | 4/1998 | Champagne | 52/11 |
| 6,052,961 | A * | 4/2000 | Gibbs | 52/518 |
| 6,167,660 | B1 * | 1/2001 | Sama | 52/58 |
| 6,470,642 | B1 * | 10/2002 | Eads | 52/518 |
| 6,904,730 | B2 * | 6/2005 | Mitchell | 52/536 |
| 6,912,813 | B2 * | 7/2005 | Grizenko | 52/58 |
| 7,278,239 | B1 * | 10/2007 | West | 52/12 |
| 7,444,790 | B2 * | 11/2008 | Hick | 52/547 |
| 7,448,177 | B2 * | 11/2008 | McClintick | 52/551 |
| 7,454,873 | B2 * | 11/2008 | McClintick | 52/551 |
| 7,478,507 | B2 * | 1/2009 | Krause | 52/546 |
| 7,530,207 | B2 * | 5/2009 | Morrill | 52/746.11 |
| 7,866,099 | B2 * | 1/2011 | Komamine et al. | 52/173.3 |
| 8,033,072 | B2 * | 10/2011 | McClintick | 52/551 |
| 8,407,960 | B2 * | 4/2013 | Morsching | 52/489.1 |
| 2001/0027625 | A1 * | 10/2001 | Webb et al. | 52/96 |
| 2002/0178671 | A1 * | 12/2002 | Gembala | 52/302.6 |
| 2003/0061771 | A1 * | 4/2003 | Kintop | 52/97 |
| 2003/0177709 | A1 * | 9/2003 | Gatherum | 52/58 |
| 2003/0177710 | A1 * | 9/2003 | Gatherum | 52/58 |
| 2005/0204647 | A1 * | 9/2005 | Zdeb et al. | 52/58 |
| 2006/0174552 | A1 * | 8/2006 | Nocito | 52/95 |
| 2007/0151171 | A1 * | 7/2007 | McClintick | 52/87 |
| 2008/0236087 | A1 * | 10/2008 | Hick | 52/546 |
| 2009/0025314 | A1 * | 1/2009 | Komamine et al. | 52/173.3 |
| 2011/0088335 | A1 * | 4/2011 | Miller et al. | 52/97 |
| 2011/0225904 | A1 * | 9/2011 | Railkar et al. | 52/173.3 |
| 2012/0110924 | A1 * | 5/2012 | Makin | 52/58 |
| 2013/0055651 | A1 * | 3/2013 | Garcia et al. | 52/58 |
| 2013/0160388 | A1 * | 6/2013 | Williams et al. | 52/551 |

* cited by examiner

EDGE ASSEMBLIES FOR SLATE AND TILE ROOFS

CROSS REFERENCE TO RELATED APPLICATION

This application claims the benefit and priority of U.S. provisional application Ser. No. 61/492,529 entitled "Edge Assemblies for Slate and Tile Roofs" filed Jun. 2, 2011, and which is incorporated herein by reference in its entirety.

BACKGROUND & SUMMARY

Slate and tile roof construction is labor intensive and requires skilled installers to properly install slate and tile roofing. A particularly difficult part of slate and tile roof construction involves the initial installation of the first row of tiles along the eave of a roof The eave must be protected with a thin protective sheet of a strip of metal. These strips, commonly referred to as "drip edges," are separately nailed or stapled over the lower edge or eave of a roof prior to any slate or tile installation to protect the eave from water damage due to rain, snow, ice, sleet, etc.

After the drip edge has been installed, a wooden strip known as a cant strip, typically having a square cross section less than one inch per side is secured to the roof by placing the cant strip on top of the drip edge and nailing the cant strip along the lower edge of the roof and through the planar surface of the drip edge which lies directly on top of the underlying eave. The cant strip provides the necessary lift or inclination to the first row of slate tiles with respect to the plane of the roof so that subsequent rows of slate tiles lay down properly on each preceding lower row of tiles.

After the drip edge and cant strip is installed, the first row of tiles is typically manually nailed to the roof with roofing nails. This requires a considerable amount of skill since an installer must apply the proper amount of force to drive a nail through the tile to securely mount the tile to the roof, but not so much force so as to break or crack the tile. The tile must also be preformed with one or more through holes for passage of the nail(s). An installer must hold a tile in place on the cant strip while carefully hammering a nail through the hole in the tile and into the underlying roof. Although conventional nail guns are quicker and easier to use, they can apply too much driving force and thereby damage the slate tiles. Accordingly, slower manual nailing is commonly required.

In accordance with this disclosure, an integral drip edge, cant strip or "kick up" and a plurality of tile retention hooks is installed as a single integral assembly using a conventional nail gun. Experienced slate installers are not required to install a slate roof using the installation system disclosed herein, as there is no requirement to drive nails through the slate tiles held by the retention hooks. Moreover, as there is no need to preform nail holes in the tiles, tiles without installation holes can be used as disclosed herein. This can reduce the cost of the tiles by eliminating the hole punching or hole forming production step. Lower cost labor can be used to install a slate tile roof in a shorter amount of time than a professional slate installer using conventional manual slate installation techniques, thereby resulting in a lower cost slate roof installation.

DESCRIPTION OF REPRESENTATIVE EMBODIMENTS

Figure 1:
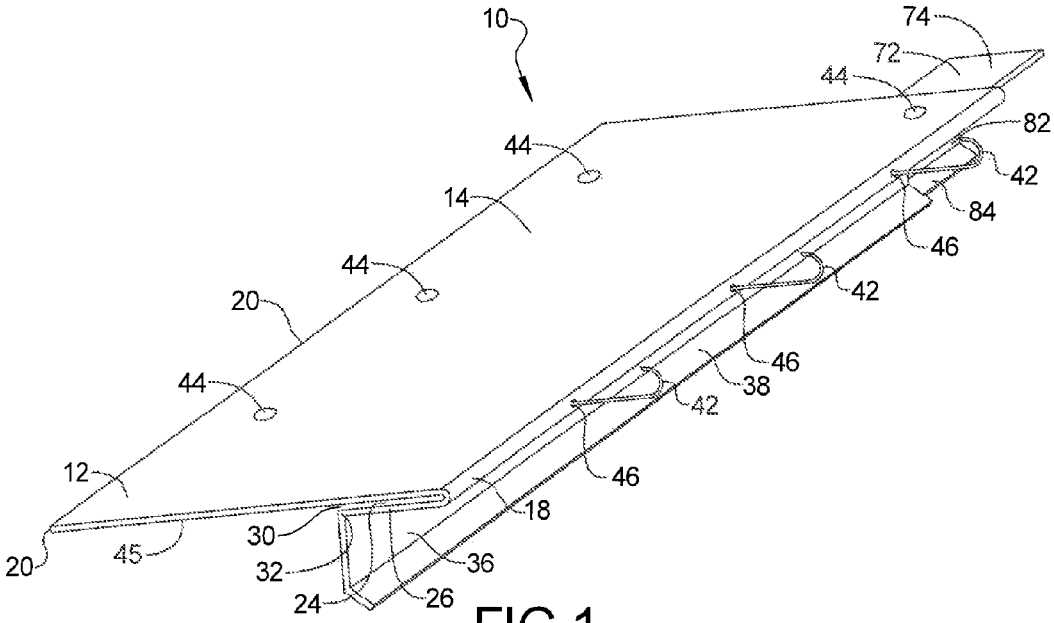
FIG. 1 is a perspective view of a representative embodiment of a drip edge assembly constructed in accordance with this disclosure.

As seen in FIG. 1, a drip edge assembly 10 is formed, such as by bending, from a thin sheet 12 of metal such as stainless steel. In some applications, a thin plastic extrusion with a thickness of a millimeter or more can be used in place of a formed metal sheet 12.

Sheet 12 is formed with an elongated planar top strip 14 which can be formed with any convenient length such as 2, 3, 4, 6, 8, 9 or 12 foot lengths or more. If required, shorter or intermediate lengths can be easily obtained by cutting the sheets 12 with tin snips or metal cutters. The width of strip 14 can in one embodiment be about four inches.

Each strip 14 has a front or leading edge portion 18 and a rear or trailing edge portion 20. Sheet 12 is folded back under the planar top strip 14 at the leading edge portion 18 so as to form a narrow slot 24 between the planar strip 14 and a bottom edge portion 26. The bottom edge portion 26 extends rearwardly for about one half inch to about one inch in the representative embodiment shown. An open mouth or gap 30 extends longitudinally along the rear edge 32 of the bottom edge portion 26.

Figure 4:
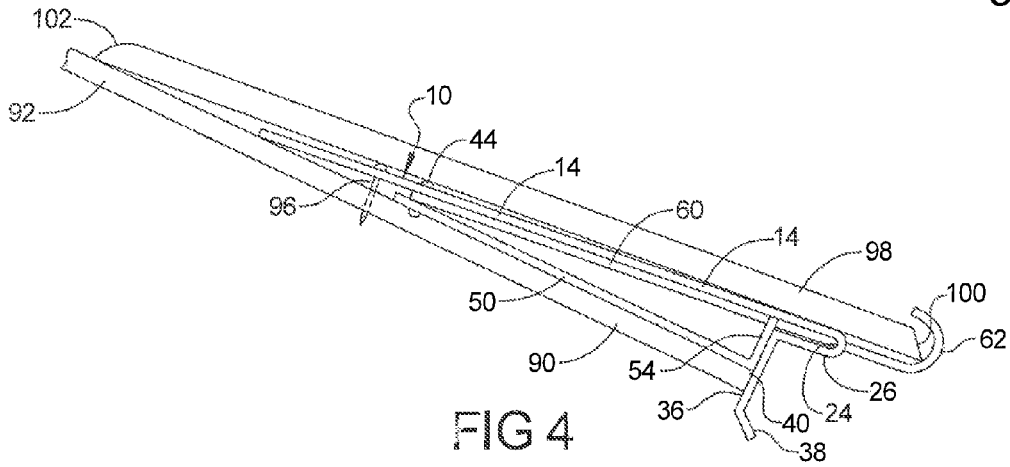
FIG. 4 is a side view of the assembly of FIGS. 1-3 mounted on an eave of a roof and supporting a roofing tile.
Figure 5:
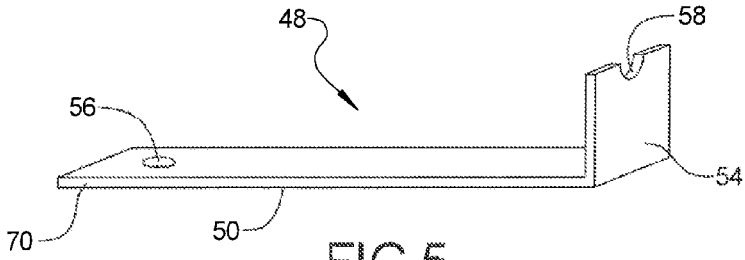
FIG. 5 is a perspective view of a lift arm.

A front wall 36 extends downwardly for about an inch from the rear edge 32 for positioning against a portion of a roof such as along the lower edge of an eave, as described further below and as shown in FIG. 4. A portion of the front wall 36 extends below the upper surface of the underlying roof supporting the drip edge assembly 10. In the example shown, a lip portion 38 extends forwardly and downwardly for about one quarter inch from the front wall 36 for directing water away from the front wall 36 and away from the eave of a roof. As further seen in FIG. 4, the front wall 36 is placed against the outer edge 40 of eave 90 to properly position the drip edge assembly 10 for installation (nailing).

Figure 2:
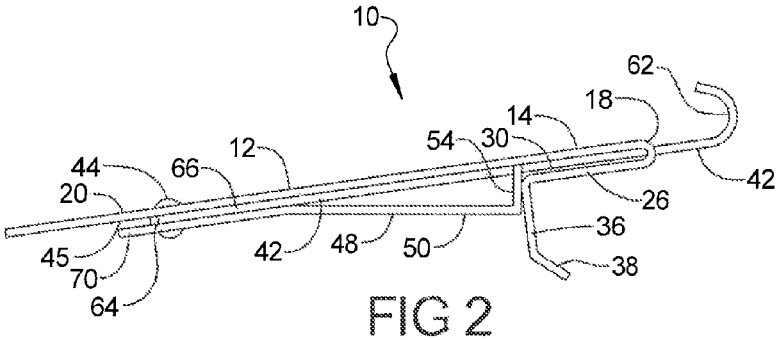
FIG. 2 is a schematic side view of FIG. 1.

As further seen in FIGS. 1 and 2, a series of tile hooks 42 is attached to the sheet 12 with a series of fasteners such as rivets 44. The front end portion of each hook extends into and through the leading edge portion 18 via a series of spaced-apart holes 46. The hooks 42 can be spaced apart at predetermined spacings. In this example, four inch spacings can be used. Each hook 42 extends rearwardly through the slot 24 and rearwardly along the underside 45 of the planar strip 14 to a position spaced from the trailing edge 20 of top strip 14.

As seen in FIGS. 2, 3, 4 and 5, a lift arm 48 located beneath the planar top strip 14 includes a base portion 50 and a cant portion 54. Cant portion 54 extends upwardly from the front portion of the base portion 50. The rear portion of the base portion 50 can be formed with a hole 56 (FIG. 5) for receiving a fastener such as one of the rivets 44. The lift arm 48 is secured to the underside 45 of the planar top strip 14 with a rivet 44 as shown in FIG. 2. A notch 58 is formed in the free upper end of cant portion 54 for receiving and holding each hook 42 in place, as described further below. As seen in FIG. 4, the cant portion 54 elevates the leading edge portion 18 and central portion of the planar top strip 14 above the surface of an underlying roof 90.

Figure 6:
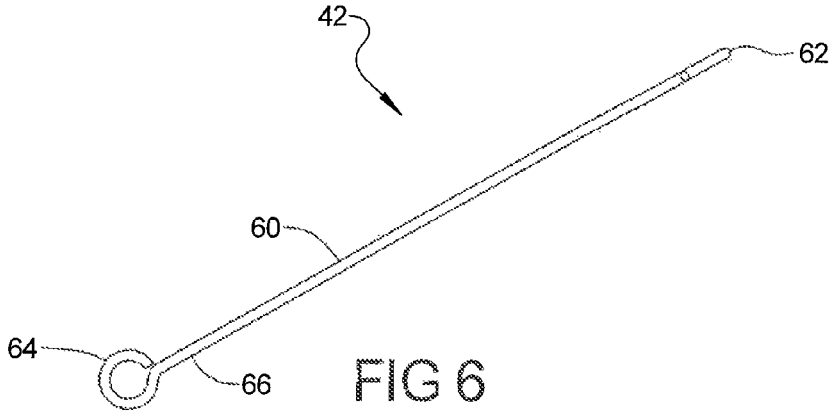
FIG. 6 is a perspective view of a tile mounting hook.

As seen in FIG. 6, the hooks 42 can be formed with a straight shank portion 60 having a hook portion 62 formed on its front end and a loop portion 64 formed on its rear end 66. Hook 42 can be formed from wire such as stainless steel or copper wire or in some applications, plastic. The hook portion 62 projects outwardly and forwardly from the leading edge portion 18 of the top strip 14 and extends upwardly in a generally vertical plane, at a right angle to the plane of the loop portion 64.

Figure 3:
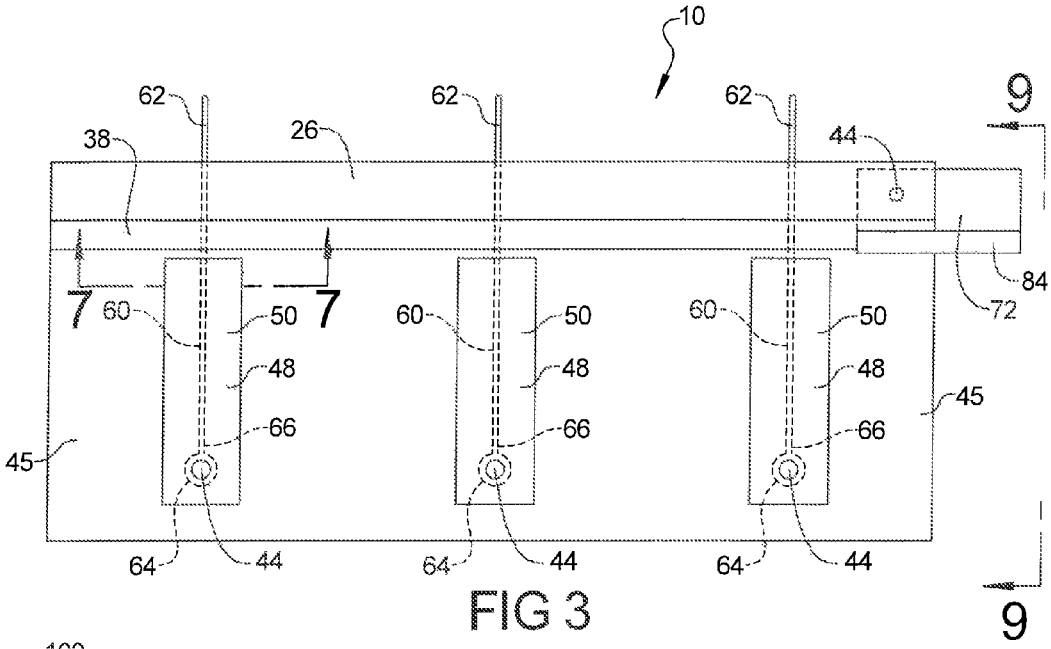
FIG. 3 is a bottom view of FIG. 1.

As further seen in FIGS. 2 and 3, the rear end 66 of each hook 42 is fixed in place on the planar top strip 14 with a fastener such as a rivet 44 passing through the loop 64. At the same time, the rear end 70 of the lift arm 48 can be fixed to the drip edge assembly 10 with the same rivet 44 passing through loop 64 and through hole 56 on the lift arm. In this manner, the rear end 66 of hook 42 is tightly clamped between the underside 45 of the planar top strip 14 and the top surface of the rear end 70 of the lift arm 48.

Figure 7:
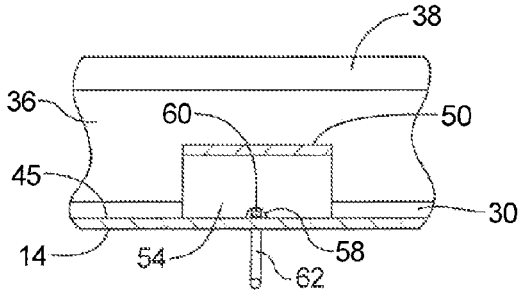
FIG. 7 is a partial view in section taken along section line 7-7 of FIG. 3.
Figure 8:
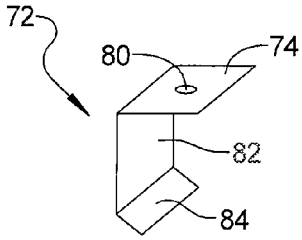
FIG. 8 is a perspective view of a mounting and alignment tab.

This laminated, "sandwiched" or clamped connection results in an upwardly-directed leaf-spring biasing force along the base portion 50 of the lift arm 48 which braces the lift arm 54 against the underside 45 of the planar top strip 14 and thereby securely holds or clamps the shank portion 60 of the hook 46 within the notch 58 formed in the top of the lift arm 54. This is shown more dearly in FIG. 7.

Two or more drip edge assemblies 10 may be accurately positioned and connected along a roof edge in series using a type of tongue-and-groove tab-and-slot or other suitable interconnection. As seen in FIGS. 1, 3, 8 and 9, an interconnection tab or tongue 72 is connected to one end of each assembly 10. Tab or tongue 72 is formed with a profile matching that of the front end of planar top strip 14 adjacent its leading edge portion 18, as well as the bottom edge portion 26, front wall 36 and lip portion 38.

Figure 9:
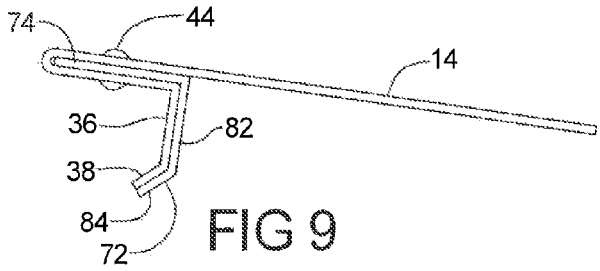
FIG. 9 is a side view of FIG. 3 taken along line 9-9 thereof.

In this embodiment, tab 72 is formed with a top wall 74 that is positioned partially within the narrow slot 24 and that extends longitudinally outwardly from the slot 24. A rivet hole 80 (FIG. 8) can be formed in the top wall 74 to receive a rivet 44 which anchors the tab 72 within the slot 24. As seen in FIG. 9, tab 72 further includes a support wall 82 and a support lip 84.

Figure 10:
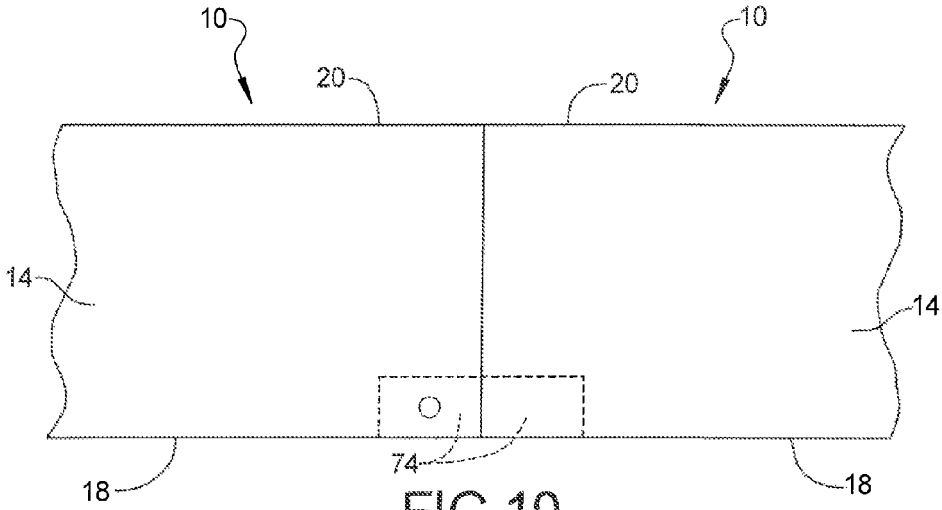
FIG. 10 is a partial top plan view of two drip edge assemblies interconnected with a tongue and groove sliding fit.
Figure 11:
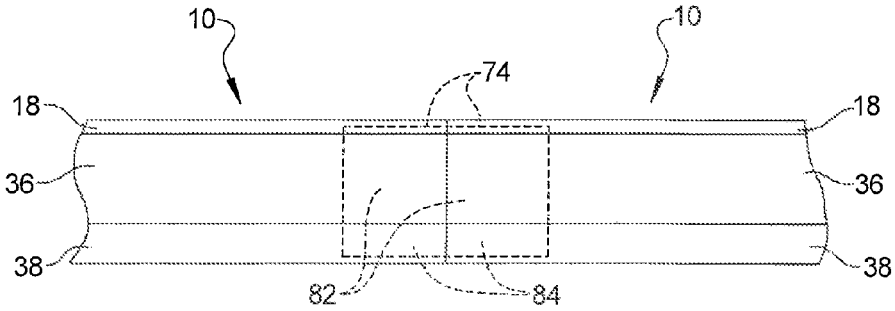
FIG. 11 is a front view of FIG. 10.

When one drip edge assembly 10 is installed along a roof eave, a second drip edge assembly 10 can be easily positioned in proper relation to the first drip edge assembly 10 by inserting the portion of the top wall 74 of tab 72 extending from the first drip edge assembly 10 into slot 24 on the second drip edge assembly. This is shown in FIGS. 10 and 11. When arranged as shown in FIGS. 10 and 11, the support wall 82 and support lip 84 of the tab 72 provide support and alignment surfaces which are located against the rear surfaces of the front wall 36 and lip portion 38.

Returning now to FIG. 4, it is seen that the drip edge assembly 10 is easily positioned over the eave 90 of a roof 92 and can be fixed in position with roofing nails 96 applied manually or by a powered nail gun. Roof 92 can be constructed from conventional roofing materials such as wooden boards, plywood and/or particle boards. Once the drip edge assembly 10 is nailed in position on eave 90 along with any additional interconnected assemblies 10, an installer need only position a row of slate tiles 98 in position on the underlying roof surface as shown. That is, the bottom edge 100 of each tile 98 is fitted within the hook portion 62 of one or more hooks 42.

No special skills are required for this simple and expedient tile roof construction and no fastener or nail holes are formed in the slate tiles such that an installer does not need to install a nail or fastener through the slate tiles 98. Additional rows of tiles can be installed over the first row of tiles 98 using conventional installation techniques.

It should be noted that the drip edge assembly 10 can be easily modified to serve as a border strip along the edge of a gable. This type of a border strip, known as a "rake edge" does not typically require any lift, "kick up" or elevation above the surface of a gable. All that is needed to produce a rake edge assembly is to eliminate the lift arm 48 from the drip edge assembly 10. This removes the cant angle from the tiles and allows for a quick installation of tiles along the edges and surfaces of gables. The underside 45 of the planar top strip 14 will lie directly on top of the underlying gable without any "lift" or "kick up."

It will be appreciated by those skilled in the art that the above edge assemblies for slate and tile roofs are merely representative of the many possible embodiments of the disclosure and that the scope of the disclosure should not be limited thereto, but instead should only be limited according to the following claims.

What is claimed is:

1. An edge assembly mounting tiles to a sloping roof surface, comprising:

a sloping roof having an outer edge portion;

an elongated top strip having a leading edge portion extending forwardly and outwardly from said outer edge portion and a trailing edge portion;

a front wall extending downwardly below said elongated top strip and positioned over said outer edge portion;

a series of tile hooks attached to said top strip and projecting forwardly and outwardly from said leading edge portion and said outer edge portion;

a roofing tile fitted within at least one of said series of tile hooks and extending forwardly and outwardly from said outer edge portion; and a bottom edge portion extending rearwardly from said leading edge portion and defining a slot between said elongated top strip and said bottom edge portion, and wherein said series of tile hooks extends within said slot.

2. The edge assembly of claim 1, further comprising a lip portion extending forwardly from said front wall for directing water away from said front wall.

3. The edge assembly of claim 1, further comprising a lift arm located below said elongated top strip, said lift arm comprising a cant portion elevating a portion of said elongated top strip over said roof surface.

4. The edge assembly of claim 1, wherein said elongated top strip and said front wall are integrally formed from a metal sheet and wherein said roofing tile comprises a slate tile.

5. The edge assembly of claim 1, wherein said roofing tile overlies said elongated top strip.

6. The edge assembly of claim 1, further comprising a lift arm disposed against an underside of said elongated top strip and holding one of said series of tile hooks in position on said edge assembly.

7. An edge assembly mounting tiles to a sloping roof surface, comprising:

a sloping roof having an outer edge portion;

an elongated top strip having a leading edge portion extending forwardly and outwardly from said outer edge portion and a trailing edge portion;

a front wall extending downwardly below said elongated top strip and positioned over said outer edge portion;

a series of tile hooks attached to said top strip and projecting forwardly and outwardly from said leading edge portion and said outer edge portion;

a roofing tile fitted within at least one of said series of tile hooks and extending forwardly and outwardly from said outer edge portion;

wherein each one of said series of tile hooks comprises a wire having a shank portion and a hook portion, and wherein said shank portion is fastened to said elongated top strip with a fastener; and a lift arm fastened to said elongated top strip with said fastener and biased against an underside of said elongated top strip.

8. The edge assembly of claim 7, wherein said front wall extends below said roof surface.

9. The edge assembly of claim 7, wherein said roofing tile is formed without a nail hole.

* * * * *